US005370104A

United States Patent [19]

Neie

[11] Patent Number: 5,370,104

[45] Date of Patent: Dec. 6, 1994

[54] ARCHERY BOW STABILIZER

[76] Inventor: Michael J. Neie, 7412 Holyoke, Amarillo, Tex. 79121

[21] Appl. No.: 23,127

[22] Filed: Feb. 26, 1993

[51] Int. Cl.[5] ..... F41B 5/20

[52] U.S. Cl. ..... 124/89; 267/177

[58] Field of Search ..... 124/23.1, 24.1, 25.6, 124/89; 267/175, 177; 42/1.06

[56] References Cited

U.S. PATENT DOCUMENTS

| | | | |
|---|---|---|---|
| 4,103,881 | 8/1978 | Simich | 267/177 |
| 4,193,587 | 3/1980 | Cline | 267/177 X |
| 4,279,091 | 7/1981 | Edwards | 42/1.06 |
| 4,457,501 | 7/1984 | Davis | 267/177 |
| 4,492,050 | 1/1985 | Kagehiro | 42/1.06 |
| 4,503,632 | 3/1985 | Cuevas | 42/1.06 |
| 4,893,606 | 1/1990 | Sisko | 124/89 |
| 4,945,666 | 8/1990 | Henry et al. | 124/89 X |
| 4,982,719 | 1/1991 | Haggard et al. | 124/89 |
| 4,986,018 | 1/1991 | McDonald | 124/89 X |
| 5,044,351 | 9/1991 | Pfeifer | 124/89 |

FOREIGN PATENT DOCUMENTS

| | | | |
|---|---|---|---|
| 1296201 | 11/1972 | United Kingdom | 124/89 |

*Primary Examiner*—Randolph A. Reese
*Assistant Examiner*—John A. Ricci

[57] ABSTRACT

A new and improved archery bow stabilizer apparatus includes a housing; a threaded connector for connecting the housing to the bow; a rigid lead weight retained in the housing; a helical spring, retained in the housing and located between a wall of the housing and the rigid weight; and a quantity of liquid oil retained in the housing. The liquid, the rigid weight, and the spring work in conjunction with each other to absorb and damp torque and vibrations from the bow when a projectile is shot. Preferably, the housing is cylindrically shaped, the rigid weight is cylindrically shaped, and the rigid weight operates in the housing as a piston in a cylinder. A portion of the damping action takes place as a portion of the damping liquid squeezes between an inner wall of the housing and an outer surface of the rigid weight when the projectile is shot. A tension-adjusting assembly is attached to an end of the housing for adjusting tension in a spring inside the housing. In addition, a lock assembly may be provided for locking the spring-tension-adjusting assembly in a predetermined position.

10 Claims, 4 Drawing Sheets

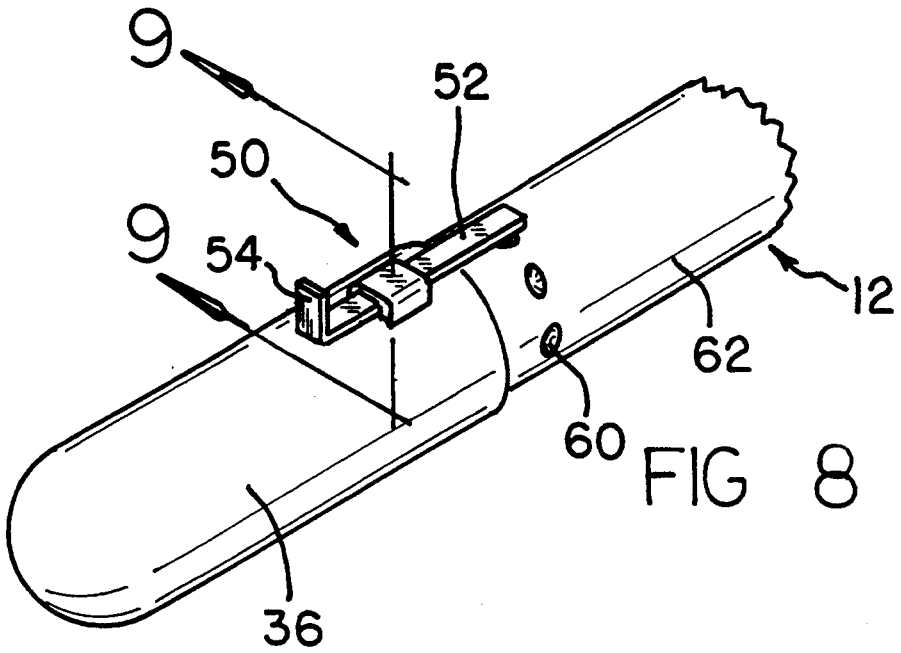
FIG 8
FIG 9
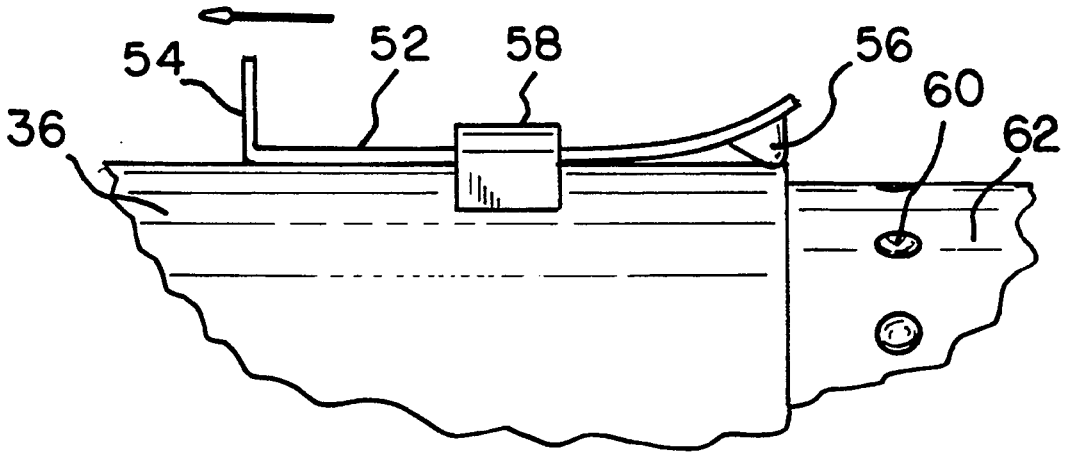

ARCHERY BOW STABILIZER

BACKGROUND OF THE INVENTION

1. Field of the Invention

The present invention relates generally to archery bow stabilizers, and more particularly, to a device that is attached to an archery bow to reduce shock and vibration of the bow when an arrow is shot.

2. Description of the Prior Art

When an archer shoots an arrow from a bow, there is a tendency of the bow to vibrate after the arrow has been shot. To decrease the vibrational effects of the bow, archery bow stabilizers have been devised to attach to the bow to add weight thereto, and thus provide more inertia to be overcome when the arrow is shot.

For example, the following prior art U.S. patents disclose stabilizers for archery bows are known: U.S. Pat. No. 3,524,441 of Jeffery; U.S. Pat. No. 3,589,350 of Hoyt et at; U.S. Pat. No. 3,628,520 of Izuta; U.S. Pat. No. 3,683,883 of Izuta; and U.S. Pat. No. 4,245,612 of Finlay.

More specifically, Jeffery discloses an archery bow stabilizer that includes a plurality of interchangeable weighted heads and rods. Hoyt et al disclose an archery bow stabilizer that includes a weighting element and an elongated telescopically adjustable support for supporting the weighting element in selective spaced relationship with a bow. In the first Izuta patent, Izuta discloses an archery bow stabilizer that includes an elongated rod member having a weighting element at one end and a number of resilient members each constructed in the form of a plurality of radially extending resilient elements. In the second Izuta patent, Izuta discloses an archery bow stabilizer that includes a plurality of permanent magnets which absorb vibration or shock by attraction or repulsion of the permanent magnets. Finlay discloses an archery bow stabilizer that emits a scent as the stabilizer is used.

Intended purposes of the above-mentioned archery bow stabilizers are to reduce torque and to damp vibrations of the bow once the arrow is shot. Yet in all of the archery bow stabilizers discussed above, all-solid weights are used to reduce torque or absorb or damp vibrations. One problem with all-solid damping devices is their inherent resilience. Such is the nature of solid materials. Some solid materials have more or less resilience than others, but the inherent resilience of solid materials is an obstacle to a more efficient damping action in an archery bow stabilizer. Thus, it would be desirable if an archery bow stabilizer were provided that avoided the inherent resiliency of an all-solid archen/bow stabilizer.

Yet, solids are generally very dense, and their density provides good torque-absorbing and good vibration damping properties. Thus, it would be desirable if an archery bow stabilizer were provided that both avoided the inherent resiliency of an all-solid stabilizer but still retained a solid stabilizer portion that took advantage of the high density of solid torque-absorbing and vibration-damping solid elements.

Vibrations that occur in a bow once an arrow is shot can be in a wide range of frequencies, from low to high frequencies. It would be desirable if an archery bow stabilizer were provided that provided bow stabilization over a wide range of vibrational frequencies.

Bows, arrows, and bow strings are made in a wide variety of sizes and weights. In this respect, it would be desirable if an archery bow stabilizer were provided that had an adjustable tension to adjust for the variety of bows, arrows, and bow strings.

Thus, while the foregoing body of prior art indicates it to be well known to use archery bow stabilizers having all-solid weights, the provision of a more simple and cost effective device that avoided the inherent resiliency of an all-solid archery bow stabilizer is not shown in the prior art. Also, the prior art does not provide an archery bow stabilizer that both avoided the inherent resiliency of an all-solid stabilizer but still retained a solid stabilizer portion that took advantage of the high density of solid damping elements. The prior art does not provide an archery bow stabilizer that provides bow stabilization over a wide range of vibrational frequencies. In addition, the prior art does not provide an archery bow stabilizer that both avoids the inherent resiliency of an all-solid stabilizer but still retains a solid stabilizer portion that takes advantage of the high density of solid torque-absorbing and vibration-damping solid elements. The prior art does not provide an archery bow stabilizer that has an adjustable tension to adjust for the variety of bows, arrows, and bow strings. The foregoing disadvantages are overcome by the unique archery bow stabilizer apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an archery bow stabilizer apparatus which includes a housing; a connector for connecting the housing to the bow; a rigid weight retained in the housing; a spring, retained in the housing and located between a wall of the housing and the rigid weight; and a quantity of a liquid retained in the housing. The liquid, the rigid weight, and the spring work in conjunction with each other to absorb and damp torque and vibrations from the bow when a projectile is shot.

Preferably, the housing is cylindrically shaped, the rigid weight is a lead weight that is cylindrically shaped, and the rigid weight operates in the housing as a piston in a cylinder. A portion of the damping action takes place as a portion of the damping liquid, which is preferably an oil, squeezes between an inner wall of the housing and an outer surface of the rigid weight when the projectile is shot.

A tension-adjusting assembly is attached to an end of the housing for adjusting tension in a spring inside the housing. The spring-tension-adjusting assembly includes a rotatable cap, a complementary flange arrangement for connecting the rotatable cap to the housing for rotatable engagement therewith, and an adjustable piston assembly. The adjustable piston assembly includes a threaded portion for engaging a complementary threaded portion in the rotatable cap, and also includes a piston end, retained in the housing, for exerting tension on one end of the spring.

In addition, a lock assembly may be provided for locking the spring-tension-adjusting assembly in a predetermined position. The lock assembly includes a sliding bar which includes a handle and a locking cam. A bracket is attached to the rotatable cap and retains the sliding bar on the cap. A plurality of detents, located on the outside surface of the housing, may be provided for receiving the locking cam when the rotatable cap is locked in a predetermined position. The sliding bar may be sufficiently resilient to permit the locking cam to ride up onto the rotatable cap when the sliding bar is pulled back away from the detents to permit the rotatable cap to be rotated.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved archery bow stabilizer apparatus which has all of the advantages of the prior art and none of the disadvantages.

It is another object of the present invention to provide a new and improved archery bow stabilizer apparatus which may be easily and efficiently manufactured and marketed.

It is a further object of the present invention to provide a new and improved archery bow stabilizer apparatus which is of durable and reliable construction.

An even further object of the present invention is to provide a new and improved archery bow stabilizer apparatus which is susceptible of a low cost of manufacture with regard to both materials and labor, and which accordingly is then susceptible of low prices of sale to the consuming public, thereby making such archery bow stabilizer apparatus available to the buying public.

Still yet a further object of the present invention is to provide a new and improved archery bow stabilizer apparatus that avoids the inherent resiliency of an all-solid archery bow stabilizer.

Yet another object of the present invention is to provide a new and improved archery bow stabilizer apparatus that provides bow stabilization over a wide range of vibrational frequencies.

Even another object of the present invention is to provide a new and improved archery bow stabilizer apparatus that both avoids the inherent resiliency of an all-solid stabilizer but still retains a solid stabilizer portion that takes advantage of the high density of solid torque-absorbing and vibration-damping solid elements.

Still a further object of the present invention is to provide a new and improved archery bow stabilizer apparatus that has an adjustable tension to adjust for a variety of bows, arrows, and bow strings.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 8 is a partial perspective view of a third embodiment of the archery bow stabilizer apparatus of the invention which includes a second means for adjusting tension in the apparatus.

FIG. 9 is an enlarged side view of the embodiment of the invention shown in FIG. 8 looking along the line 9—9 in FIG. 8.

DESCRIPTION OF THE PREFERRED EMBODIMENT

Figure 1:
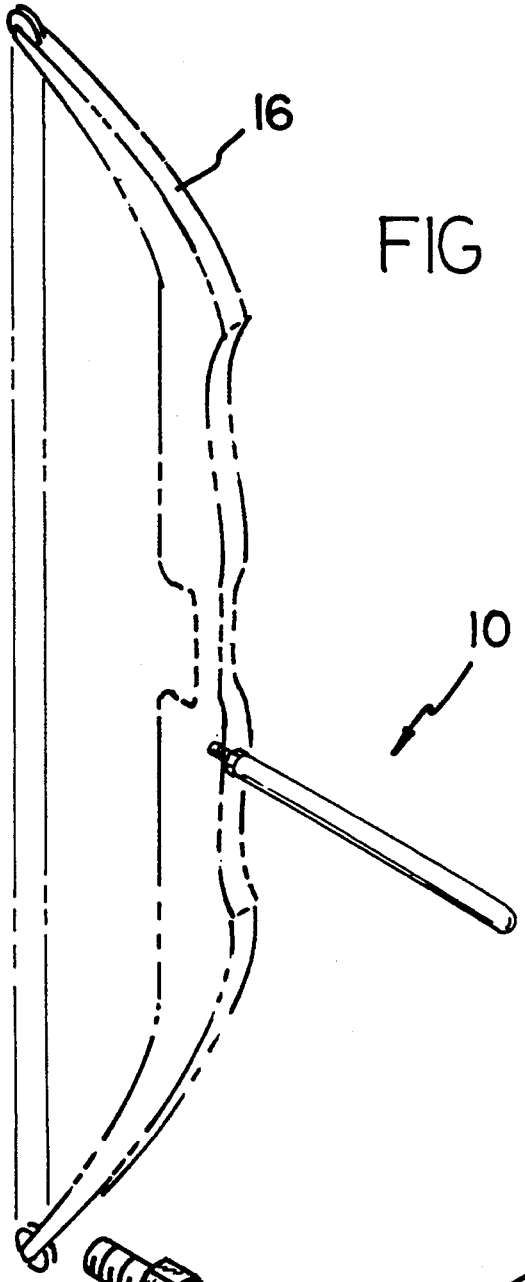
FIG. 1 is a perspective view showing a first preferred embodiment of the archery bow stabilizer apparatus of the invention attached to a bow.
Figure 2:
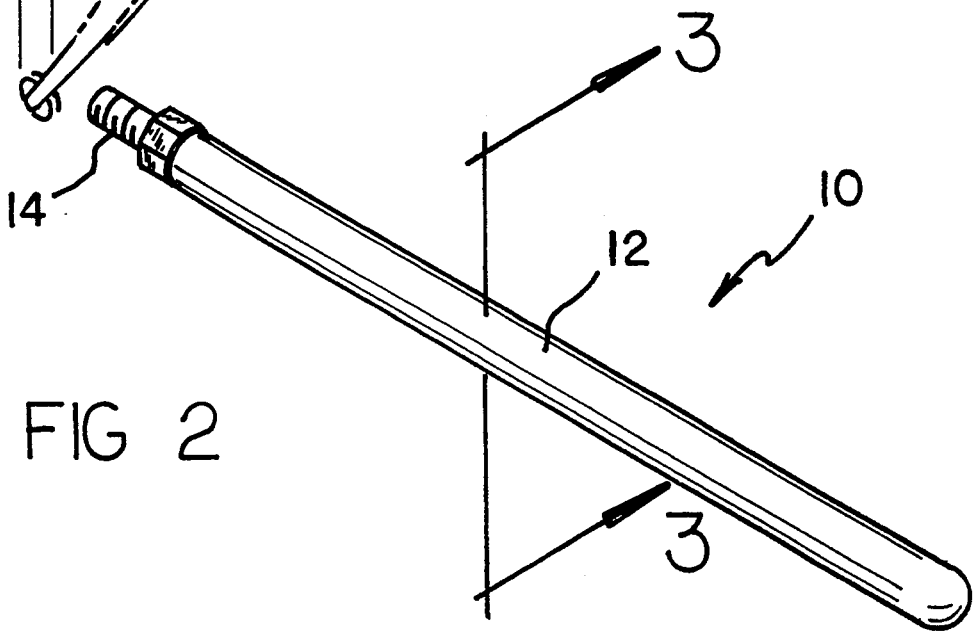
FIG. 2 is an enlarged perspective view of the embodiment of the archery bow stabilizer apparatus of the invention shown in FIG. 1 removed from the bow.
Figure 3:
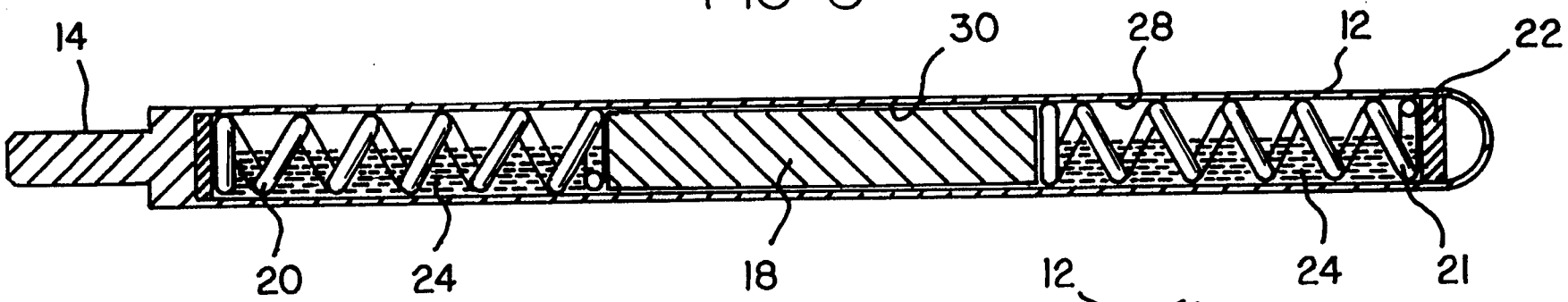
FIG. 3 is an enlarged cross-sectional view of the archery bow stabilizer apparatus of the invention shown in FIG. 2 taken along line 3—3 thereof.
Figure 4:
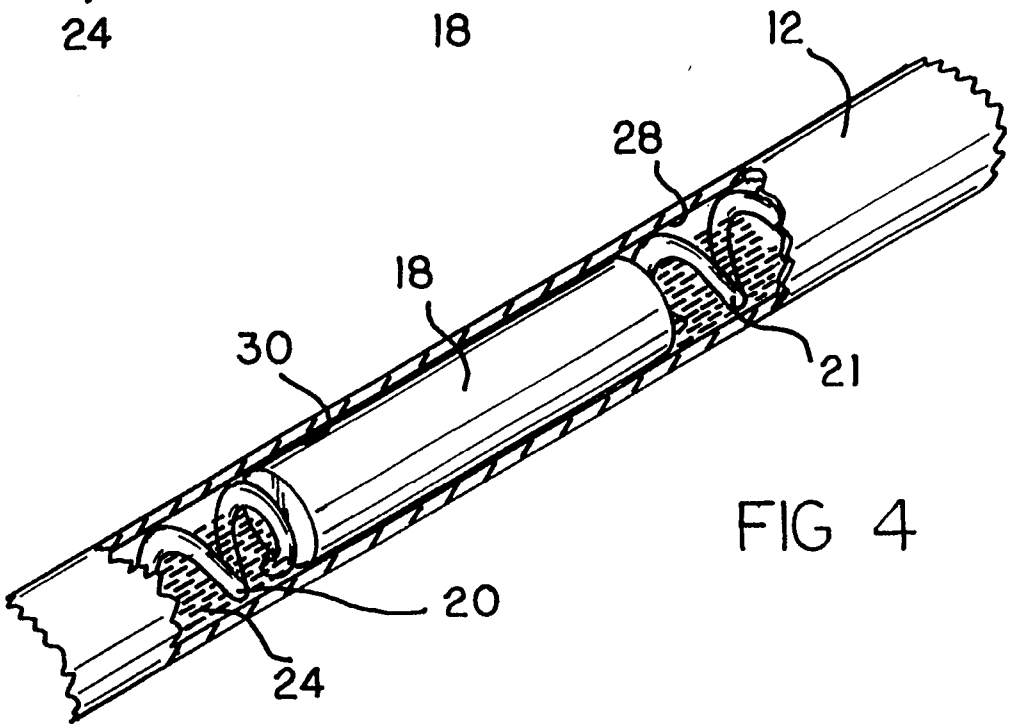
FIG. 4 is a partial perspective view of the embodiment of the archery bow stabilizer apparatus of the invention shown in FIG. 2 with a portion of the outer housing removed. invention.

With reference to the drawings, a new and improved archery bow stabilizer apparatus embodying the principles and concepts of the present invention will be described.

Turning initially to FIGS. 1–4, there is shown a first exemplary embodiment of the archery bow stabilizer apparatus of the invention generally designated by reference numeral 10. In its preferred form, archery bow stabilizer apparatus 10 comprises a housing 12, a threaded connector 14, for connecting the housing 12 to the bow 16 (having a complementary threaded well for receiving the threaded connector 14), a rigid lead weight 18, retained in the housing 12, and two helical springs 20 and 21, retained in the housing 12 and located between an interior wall 22 inside the housing 12 and the rigid weight 18. The springs 20 and 21, in conjunction with the rigid weight 18, serve to absorb and damp vibrations from the bow 16 when a projectile (not shown) is shot from the bow 16. A quantity of liquid oil 24 is retained in the housing 12 and also absorbs and damps vibrations from the bow 16, in conjunction with the rigid weight 18 and the springs 20 and 21, when a projectile is shot from the bow 16.

The housing 12 is cylindrically shaped as is the rigid weight 18. As a result, the rigid weight 18 operates in the housing 12 as a piston in a cylinder. Moreover, additional damping action takes place as a portion of the damping liquid oil 24 squeezes between an inner wall 28 of the housing 12 and an outer surface 30 of the rigid weight 18.

Figure 5:
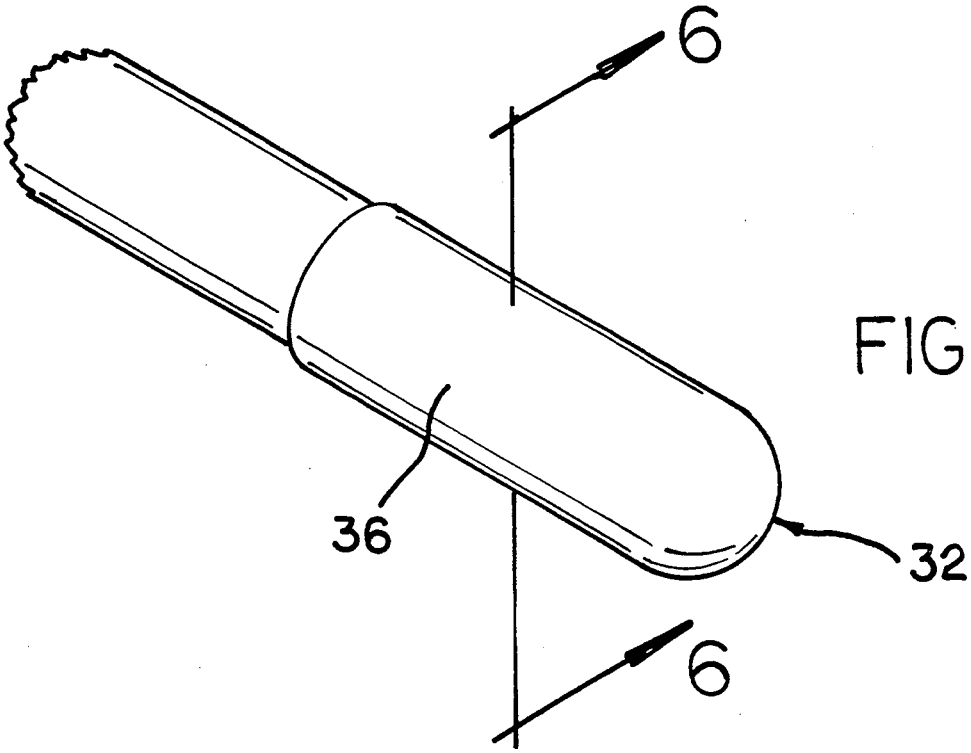
FIG. 5 is a partial perspective view of a second embodiment of the archery bow stabilizer apparatus of the invention which includes a first means for adjusting tension in the apparatus.
Figure 6:
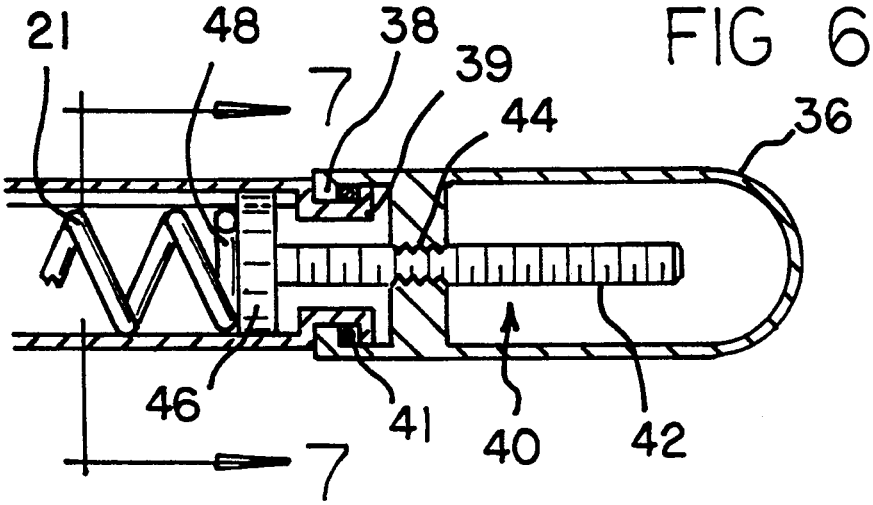
FIG. 6 is a partial cross-sectional view of the means for adjusting tension in the apparatus taken along the line 6—6 in FIG. 5.
Figure 7:
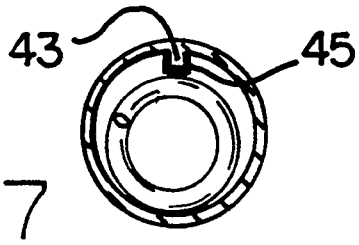
FIG. 7 is a cross-sectional view of the embodiment of the archery bow stabilizer apparatus of the invention shown in FIG. 6 taken along the line 7—7.

Turning to FIGS. 5–7, a second embodiment of the archery bow stabilizer apparatus of the invention is shown. Reference numerals are shown that correspond to like reference numerals that designate like elements shown in the other Figures. In addition, in FIGS. 5–7, means 32, attached to an end 34 of the housing 12, are provided for adjusting tension in the spring 20.

More specifically, the spring-tension-adjusting means 32 includes a rotatable cap 36, interconnecting flanges 38 and 39 for connecting the rotatable cap 36 to the housing 12 for rotatable engagement therewith. The flange 38 is located on the rotatable cap 36; and the flange 39 is located on the housing 12. An adjustable piston assembly 40 includes a threaded portion 42 for engaging a complementary threaded portion 44 in the rotatable cap 36. The adjustable piston assembly 40 also includes a piston end 46, retained in the housing 12, for exerting tension on one end 48 of the spring 21. In operation, as the rotatable cap 36 is rotated in one direction (either clockwise or counterclockwise for tightening or loosening tension, respectively), the interconnecting flanges 38 and 39 rotate with respect to one another with a O-ring seal 41 located therebetween. A keyway 43 is present projecting out from the inner wall 28 of the housing 12 and engages a complementary notch 45 on the piston end 46 to prevent the piston end 46 from rotating when the rotatable cap 36 is rotated. The threaded portion 42 is either pushed to the left in FIG. 6 (to tighten spring 21) or pulled to the right in FIG. 6 (to lessen tension on spring 21).

When the threaded portion 42 is pushed to the left, piston end 46 squeezes the spring 21 to a higher tension. When the threaded portion 42 is pulled to the right, piston end 46 permits the spring 21 to relieve some of its tension. And the tension applied to the spring 21 is transmitted to the rigid weight 18 and the spring 20 which alters the energy absorbing and characteristics of the archery bow stabilizer apparatus 10 of the invention.

Turning to FIGS. 8–9, a third embodiment of the archery bow stabilizer apparatus of the invention is shown. Reference numerals are shown that correspond to like reference numerals that designate like elements shown in the other Figures. In addition, in FIGS. 8–9, a locking assembly 50 is provided for locking the spring-tension-adjusting means in a predetermined position.

More specifically, the locking assembly 50 includes a sliding bar 52 which includes a handle 54 and a locking cam 56. A bracket 58 is attached to the rotatable cap 36 for retaining the sliding bar 52 on the cap 36. As shown in FIG. 8, a plurality of detents 60, located on the outside surface 62 of the housing 12, are provided for receiving the locking cam 56 when the rotatable cap 36 is locked in a predetermined position for exerting a predetermined tension on the spring 21, the rigid weight 18, and the spring 21. As shown in FIG. 9, the sliding bar 52 is sufficiently resilient to permit the locking cam 56 to ride up onto the rotatable cap 36 when the sliding bar 52 is pulled back away from the detents 60 to permit the rotatable cap 36 to be rotated.

The housing can be made from stainless steel or other suitable metal. The rigid weight can be made from lead metal or other suitable metal. The liquid oil can be motor oil, and the viscosity chosen can depend on the damping and energy absorbing properties desired. The springs can be selected for their modulus of elasticity depending upon the degree of tension desired. If desired, all the interior components of the archery bow stabilizer apparatus of the invention can be permenantly sealed inside the housing.

The selection of the springs, the oil, and the rigid weight can be customized for desired damping and energy absorbing properties with respect to a particular bow with a particular bow string having a particular bow string tension.

It is apparent from the above that the present invention accomplishes all of the objects set forth by providing a new and improved archery bow stabilizer apparatus that is low in cost, relatively simple in design and operation, and which may advantageously be used to absorb torque energy and vibrational energy when a projectile is fired from a bow.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. An archery bow stabilizer apparatus, comprising:
a housing;
means, for connecting said housing to the bow;
a rigid weight, retained in said housing;
spring means, retained in said housing and located between a wall of said housing and said rigid weight, said spring means, in conjunction with said rigid weight, for absorbing and damping vibrations from the bow when a projectile is shot; and a quantity of liquid means, retained in said housing, for absorbing and damping vibrations from the bow, in conjunction with said rigid weight and said spring means, when a projectile is shot, further comprising:

means, attached to an end of said housing, for adjusting tension in said spring means, wherein said spring-tension-adjusting means includes:

a rotatable cap;

means for connecting said rotatable cap to said housing for rotatable engagement therewith; and an adjustable piston assembly means which includes a threaded portion for engaging a complementary threaded portion in said rotatable cap, and includes a piston end means, retained in said housing, for exerting tension on one end of said spring means.

2. The apparatus described in claim 1 wherein said liquid means is an oil.

3. The apparatus described in claim 1 wherein said spring means is a helical spring.

4. The apparatus described in claim 1 wherein said rigid weight is a lead weight.

5. The apparatus described in claim 1 wherein said spring means includes two separate spring elements and with a rigid weight located therebetween.

6. The apparatus described in claim 1 wherein:

said housing is cylindrically shaped;

said rigid weight is cylindrically shaped; and said rigid weight operates in said housing as a piston in a cylinder.

7. The apparatus described in claim 6 wherein damping action of said quantity of damping liquid means takes place as a portion of said damping liquid means squeezes between an inner wall of said housing and an outer surface of said rigid weight.

8. The apparatus described in claim 1, further including locking means for locking said spring-tension-adjusting means in a predetermined position.

9. The apparatus described in claim 8 wherein said locking means includes:

a sliding bar which includes a handle and a locking cam;

bracket means, attached to said rotatable cap, for retaining said sliding bar on said cap; and a plurality of detents, located on the outside surface of said housing, for receiving said locking cam when said rotatable cap is locked in a predetermined position.

10. The apparatus described in claim 9 wherein said sliding bar is sufficiently resilient to permit said locking cam to ride up onto said rotatable cap when said sliding bar is pulled back away from said detents to permit said rotatable cap to be rotated.

* * * * *